US007040734B2

(12) United States Patent
Nakashima et al.

(10) Patent No.: US 7,040,734 B2
(45) Date of Patent: May 9, 2006

(54) BELT CONVEYING MECHANISM FOR INK-JET RECORDING APPARATUS AND INK-JET RECORDING APPARATUS INCLUDING IT

(75) Inventors: Atsuhisa Nakashima, Handa (JP); Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 83 days.

(21) Appl. No.: 10/669,876

(22) Filed: Sep. 25, 2003

(65) Prior Publication Data

US 2004/0119777 A1 Jun. 24, 2004

(30) Foreign Application Priority Data

Sep. 26, 2002 (JP) ..... 2002-280098
Sep. 26, 2002 (JP) ..... 2002-280595

(51) Int. Cl.
*B41J 2/165* (2006.01)
*B41J 2/01* (2006.01)

(52) U.S. Cl. ..... 347/33; 347/104

(58) Field of Classification Search ..... 347/30–36, 347/22, 102, 104; 271/198, 275, 276; 400/635
See application file for complete search history.

(56) References Cited

U.S. PATENT DOCUMENTS 4,935,753 A * 6/1990 Lehmann et al. ..... 347/33
5,517,222 A * 5/1996 Sugiyama et al. ..... 347/35
5,708,467 A * 1/1998 Yoshikawa et al. ..... 347/213
5,717,446 A * 2/1998 Teumer et al. ..... 347/35
6,672,705 B1 * 1/2004 Kitahara et al. ..... 347/42
2004/0100544 A1 * 5/2004 Okamoto et al. ..... 347/104

FOREIGN PATENT DOCUMENTS

JP A 2001-105583 4/2001
JP A 2001-113690 4/2001
JP A 2001-287377 10/2001

* cited by examiner

*Primary Examiner*—Juanita D. Stephens
(74) *Attorney, Agent, or Firm*—Oliff & Berridge, PLC

(57) ABSTRACT

An ink-jet printer comprises a belt conveying mechanism including two rollers, a conveyor belt stretched between the rollers to convey a paper, and the like. A recessed portion is formed on a surface of the conveyor belt, and a plurality of protrusions serving as an ink holding portion is formed within the recessed portion. Ink is ejected into the recessed portion during a flushing, and the conveyor belt runs with the ink being held between the protrusions within the recessed portion. An ink removing member contacts with the protrusions to absorb and remove the ink held between the plurality of protrusions.

20 Claims, 8 Drawing Sheets

BELT CONVEYING MECHANISM FOR INK-JET RECORDING APPARATUS AND INK-JET RECORDING APPARATUS INCLUDING IT

BACKGROUND OF THE INVENTION

1. Field of the Invention

The present invention relates to a belt conveying mechanism used for conveying a record medium in an ink-jet recording apparatus for conducting recordings by ejecting ink onto a record medium, and also to an ink-jet recording apparatus including the belt conveying mechanism.

2. Description of Related Art

An ink-jet recording apparatus is an apparatus for forming a desired image on a paper by ejecting ink through nozzles formed in a head to attach the ink on the paper. In such an ink-jet recording apparatus, a belt conveying mechanism may be used as a mechanism for conveying a paper as a record medium. When a head has a large occupation length in a paper running direction, a relatively short paper cannot be conveyed by a roller conveying mechanism in which pairs of rollers pinch and put forward a paper without using a belt. A belt conveying mechanism, however, can convey such a short paper.

In an ink-jet recording apparatus, on the other hand, when ink is continuously not ejected from nozzles for a long time period, a surface of an ink meniscus becomes dry and a defective ink ejection may be caused. In order to prevent this phenomenon, a so-called flushing, i.e., a forcible ejection of ink from nozzles toward a place other than a paper during a non-printing term, must regularly be performed.

A serial-type ink-jet recording apparatus, in which a head reciprocates perpendicularly to a paper running direction, can speedily perform a flushing by moving the head away from a paper conveyance path during a non-printing term. However, in a line-type ink-jet recording apparatus, in which a head is fixedly arranged along a direction perpendicular to a paper running direction, for example in case of adopting the above-mentioned belt conveying mechanism as a paper conveying mechanism, a member for catching ink need be moved to a position facing the head after a withdrawal of the belt conveying mechanism or the head. This leads to a complicated structure and a difficulty in a speedy flushing.

As a technique for performing a speedy flushing in a line-type ink-jet recording apparatus having a belt conveying mechanism, there may be mentioned a technique in which an opening is formed in a part of a conveyor belt, a recovery mechanism including an absorber is provided at a position facing a head with the conveyor belt sandwiched therebetween, and ink is ejected toward the opening to be absorbed within the recovery mechanism when the opening in the conveyor belt is positioned below the head.

The above technique, however, causes a problem that strength of the conveyor belt is largely decreased due to the opening in the conveyor belt, and therefore, a desired belt tension cannot be obtained to deteriorate a paper conveying function, or a life of the conveyor belt becomes short.

SUMMARY OF THE INVENTION

An object of the present invention is to provide a belt conveying mechanism for an ink-jet recording apparatus capable of, particularly in a line-type ink-jet recording apparatus, performing a speedy flushing with a relatively simple structure and reducing a deterioration in strength of a conveyor belt, and also to provide an ink-jet recording apparatus including the belt conveying mechanism.

In order to achieve the above object, according to an aspect of the present invention there is provided a belt conveying mechanism for an ink-jet recording apparatus, comprising a plurality of rollers; a conveyor belt that conveys a record medium thereon, the conveyor belt spanned the plurality of rollers; an ink holding portion that holds ink, the ink holding portion arranged on a surface of the conveyor belt; and an ink removing member that removes the ink held in the ink holding portion.

With the above construction, a speedy flushing can be performed with a relatively simple structure without a withdrawal of a conveyor belt or a head, by ejecting ink toward the ink holding portion arranged on the surface of the conveyor belt. Moreover, since no opening is formed in the conveyor belt, a deterioration in strength of the conveyor belt can be reduced.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

A general construction of an ink-jet printer (ink-jet recording apparatus) comprising a belt conveying mechanism according to a first embodiment of the present invention will firstly be described with reference to FIG. 1. An ink-jet printer 1 of this embodiment is a color ink-jet printer having four ink-jet heads 2. Within the ink-jet printer 1, a paper feed unit 11 and a paper discharge unit 12 are provided in left and right portions of FIG. 1, respectively. A paper conveyance path is formed extending from the paper feed unit 11 to the paper discharge unit 12 within the ink-jet printer 1.

Figure 1:
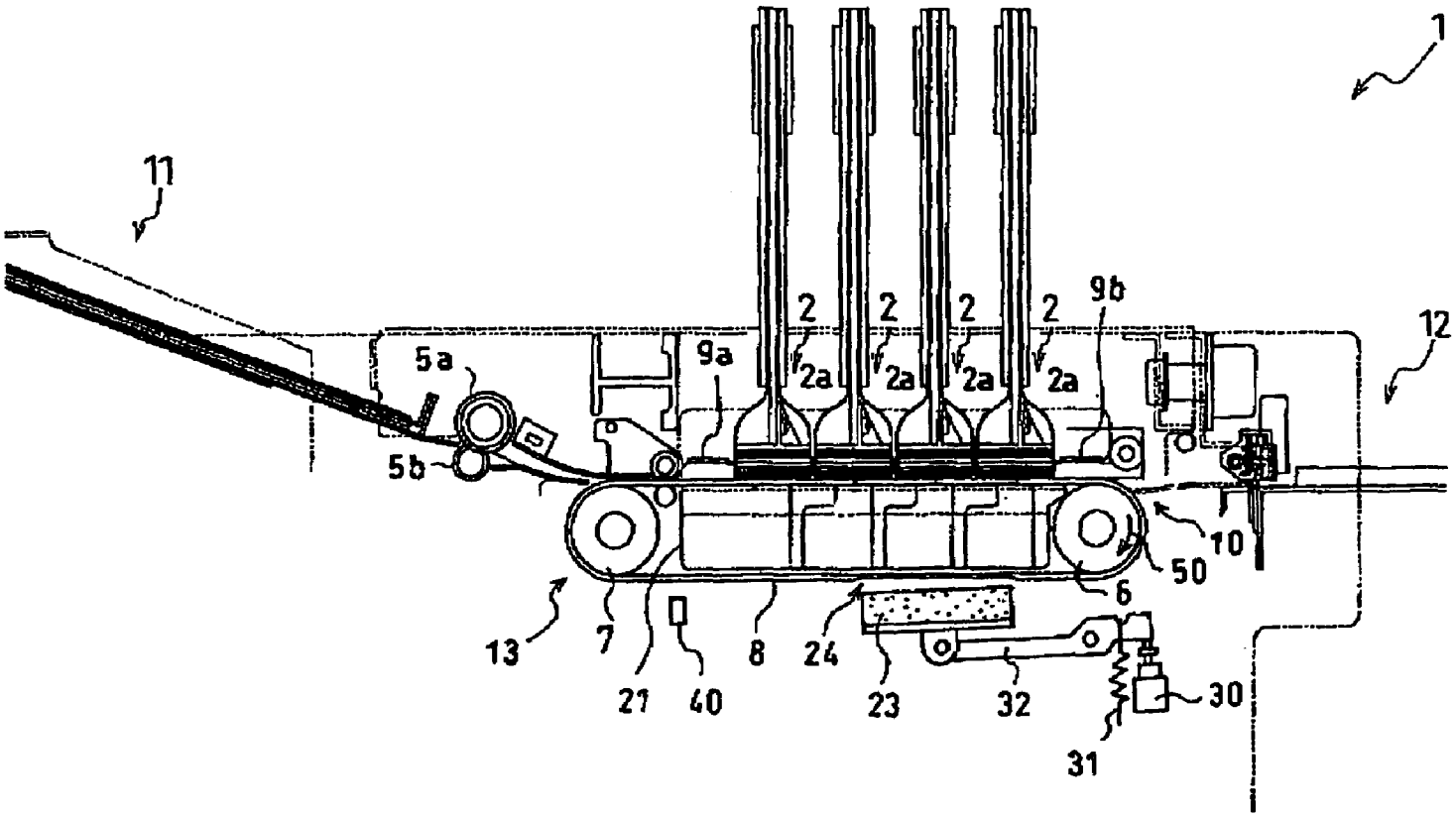
FIG. 1 is a front view of an ink-jet printer (ink-jet recording apparatus) comprising a belt conveying mechanism according to a first embodiment of the present invention.

A pair of paper feed rollers 5*a* and 5*b* are disposed immediately downstream of the paper feed unit 11 for putting forward paper as a record medium from left to right in FIG. 1. In a middle of the paper conveyance path, two belt rollers 6 and 7 and an endless conveyor belt 8 are disposed. The conveyor belt 8 is wound on the belt rollers 6 and 7 to be stretched between them.

Figure 3:
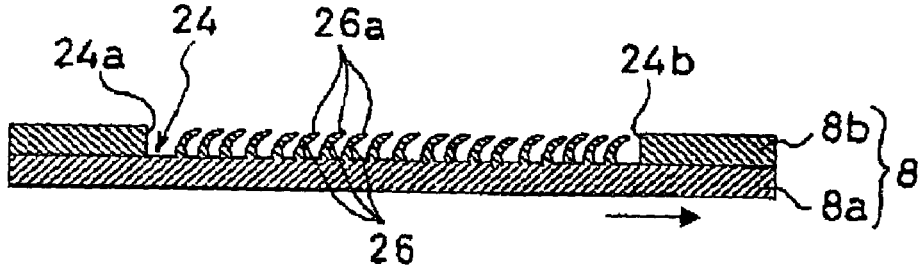
FIG. 3 is a sectional view taken along line III—III in FIG. 2.

The conveyor belt 8 has a two-layered structure made up of a polyester base body impregnated with urethane and a silicone rubber (see FIG. 3). The silicone rubber is disposed in an outer portion of the conveyor belt 8 to form a conveying surface. A paper fed through the pair of paper feed rollers 5*a* and 5*b* is kept on the conveying surface of the conveyor belt 8 by adhesion. In this state, the paper is conveyed downstream, i.e., rightward in FIG. 1, by driving one belt roller 6 to rotate clockwise in FIG. 1 as indicated by an arrow 50.

Pressing members 9*a* and 9*b* are provided at positions for feeding a paper onto the conveyor belt 8 and discharging the paper from the conveyor belt 8, respectively. Either of the pressing members 9*a* and 9*b* is for pressing the paper onto the conveying surface of the conveyor belt 8 so as to prevent the paper from separating from the conveying surface, thereby surely keeping the paper on the conveying surface.

A peeling device 10 is provided in the paper conveyance path immediately downstream of the conveyor belt 8, i.e., on the right in FIG. 1. The peeling device 10 peels off the paper, which is kept on the conveying surface of the conveyor belt 8 by adhesion, from the conveying surface so that the paper can be transferred toward the rightward paper discharge unit 12.

Each of the four ink-jet heads 2 has, at its lower end, a head main body 2*a*. Each head main body 2*a* has a rectangular section. The head main bodies 2*a* are arranged close to each other with a longitudinal axis of each head main body 2*a* being perpendicular to a paper conveyance direction, i.e., perpendicular to FIG. 1. That is, this printer 1 is a line-type printer. A large number of nozzles are formed on a bottom face of each of the four head main bodies 2*a*, and the four head main bodies 2*a* eject ink of magenta, yellow, cyan, and black, respectively.

The head main bodies 2*a* are disposed such that a narrow clearance is formed between a lower face of each head main body 2*a* and the conveying surface of the conveyor belt 8. The paper conveyance path is formed within the clearance. In this construction, while a paper, which is being conveyed by the conveyor belt 8, passes immediately below the four head main bodies 2*a* in order, the respective color inks are ejected through the corresponding nozzles toward an upper face, i.e., a print face, of the paper to form a desired color image on the paper.

A reflection-type photosensor 40 for detecting a position of the conveyor belt 8 (in more detail, a position of a below-described recessed portion 24) is disposed near the roller 6 along a lower path of the conveyor belt 8. The photosensor 40 is disposed away from a surface of the conveyor belt 8 and comprises a light-emitting portion and a light-receiving portion.

In a region surrounded by the conveyor belt 8, a nearly rectangular parallelepiped guide 21 having its width substantially equal to that of the conveyor belt 8 is arranged at an opposite position to the ink-jet heads 2. The guide 41 is in contact with the lower face of the upper part of the conveyor belt 8 to support the upper part of the conveyor belt 8 from inside.

Figure 2:
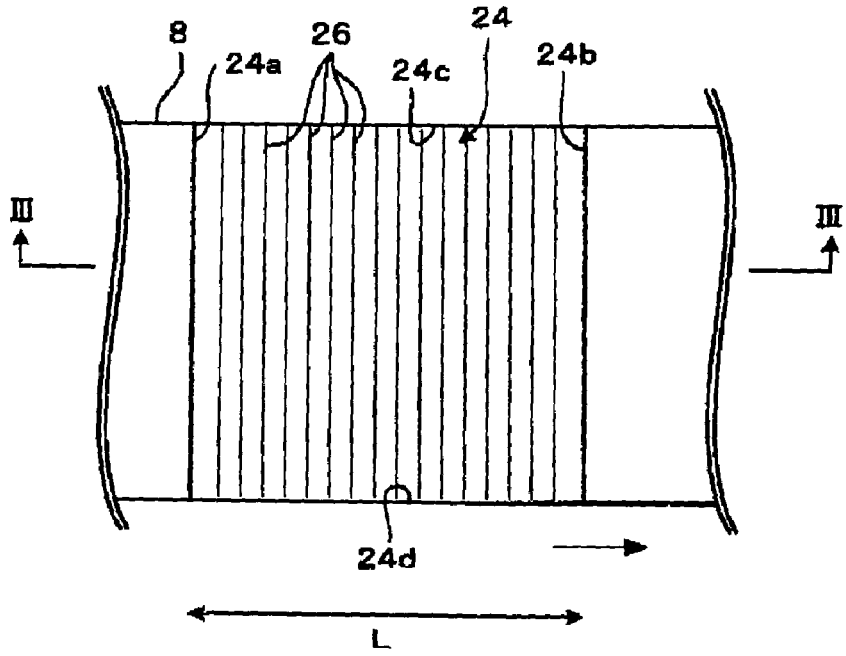
FIG. 2 is a partial plan view of a conveyor belt illustrated in FIG. 1.
Figure 4:
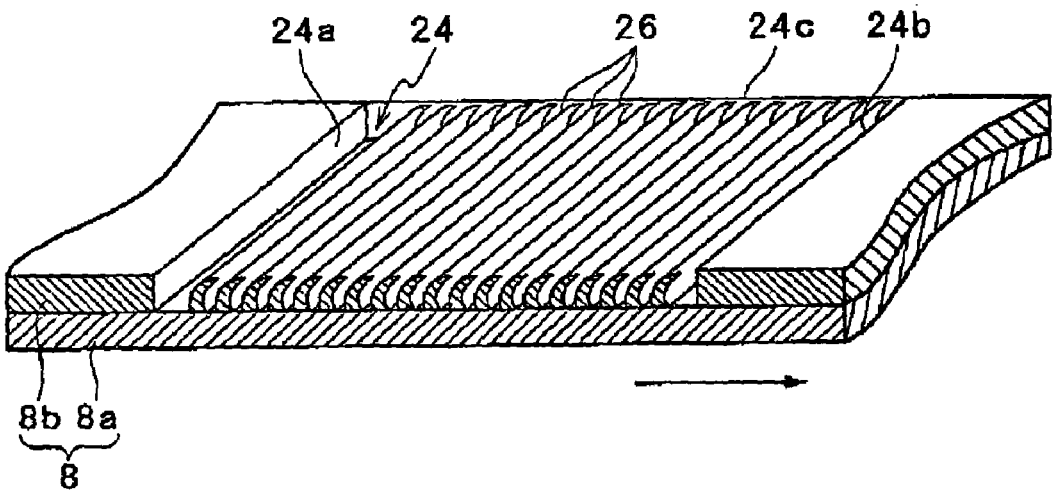
FIG. 4 is a partial perspective view of the conveyor belt illustrated in FIG. 2.

A nearly rectangular parallelepiped ink removing member 23 made of felt is arranged at a position along the lower path or the conveyor belt 8 slightly shifted toward the roller 6 from a middle between the rollers 6 and 7. The ink removing member 23 is a member for removing ink held by below-described protrusions (ink holding portion) 26 as illustrated in FIGS. 2 to 4. By a drive mechanism such as a solenoid 30, etc., as will be described later in detail, the ink removing member 23 can selectively take a position for being in contact with the protrusions 26 and a position for being out of contact with the protrusions 26. The ink removing member 23 has the same length as a below-described recessed portion 24 in a running direction of the conveyor belt 8, and therefore, the ink removing member 23 can effectively remove ink in the overall range of the recessed portion 24.

A belt conveying mechanism 13 of this embodiment is constituted by the ink removing member 23, the conveyor belt 8, and the like.

The conveyor belt 8 has a two-layered structure laminated with two sheets. An inner sheet 8*a*, as described above, is made of polyester base material impregnated with urethane, and an outer sheet 8*b* is made of silicone rubber (see FIG. 3). Additionally, because part of the inner sheet 8*a* is not covered by the outer sheet 8*b*, a single recessed portion 24 that has a height that is the same as the thickness of the outer sheet 8*b* is disposed in the surface of the conveyor belt 8.

A paper conveyance timing in the ink-jet printer 1 is adjusted such that a paper may be conveyed on a part of the conveyor belt 8 other than the recessed portion 24, Referring to FIGS. 2 to 4, the recessed portion 24 has, in a plan view, an almost same width as a belt width, and a rectangular shape with both of a stepped portion 24*a* at an upstream of a running direction of the conveyor belt 8 (as indicated by an arrow in FIGS. 2 to 4, hereinafter simply referred to as "running direction") and a stepped portion 24*b* at a downstream of the running direction forming straight lines along a widthwise direction of the belt. Thin sidewalls 24*c* and 24*d* having a height equal to the thickness of the outer sheet 8*b* are formed at both ends of the recessed portion 24 in the widthwise direction of the belt.

Many protrusions 26 protruding perpendicularly to a bottom face of the recessed portion 24 are formed on the bottom face of the recessed portion 24. Each protrusion 26 has an overhanging portion 26*a* with a tip thereof inclining toward the downstream of the running direction. Each of the protrusions 26 has a height slightly less than the thickness of the outer sheet 8*b* and thereby the protrusions 26 are positioned below the conveying surface of the conveyor belt 8 on which a paper is conveyed. Accordingly, a paper conveyed on the conveying surface is in no contact with the protrusions 26, so that ink flushed into the recess portion 24, as described later, may not adhered to the paper. Also, the protrusions 26 extends in parallel with each other in the widthwise direction of the belt (perpendicularly to the running direction of the conveyor belt 8), as illustrated in FIGS. 2 and 4. That is, each protrusion 26 is formed in a wall-like shape, and many grooves extending in the widthwise direction of the belt are formed in the recessed portion 24 by the protrusions 26.

The protrusions 26 are made of materials having water repellency such as rubbers and resins. The bottom face of the recessed portion 24 between the neighboring protrusions 26 is covered with materials having water repellency such as rubbers and resins. Since all of a surface of each protrusion 26 and the bottom face of the recessed portion 24 between the neighboring protrusions 26 have water repellency, any moisture such as ink is not absorbed into the conveyor belt 8. Moisture such as ink is held by the protrusions 26 arranged in the recessed portion 24, within a range of volume limit defined by heights of the stepped portions 24*a* and 24*b* and sidewalls 24*c* and 24*d*. Such a configuration in the recessed portion 24 may be realized by, for example, a rubber sheet having many protrusions 26 integrally formed thereon being arranged on the inner sheet 8*a*, and may be realized by other methods.

In the recessed portion 24, a distance L (see FIG. 2) between the stepped portion 24*a* and the stepped portion 24*b* is slightly longer than twice the width of the head main body 2*a*. This is because two ink-jet heads 2 are set to form one unit for performing a flushing toward the recessed portion 24, as described later. However, since the conveyor belt 8 is not stopped in flushing, as described later, it is not limited to perform a flushing with two ink-jet heads 2 set as one unit. The distance L in the recessed portion 24 is preferably short from the viewpoint of enlarging an area of the conveying surface of the conveyor belt 8.

A position of the recessed portion 24 can be detected by the above-described photosensor 40 (see FIG. 1). The light-emitting portion in the photosensor 40 constantly emits light toward the surface of the conveyor belt 8, and the light-receiving portion receives light reflected from the surface of the conveyor belt 8. An intensity, etc., of the reflected light detected by the light-receiving portion is used to detect whether or not the recessed portion 24 is in a position where the photosensor is arranged. Based on this detection result and a running speed of the conveyor belt 8, a position of the recessed portion 24 at any optional point can be found. Moreover, a position of the recessed portion 24 can also be sensed by, for example, forming a detection mark on the surface of the conveyor belt 8 at a position properly apart from the recessed portion 24, and detecting this mark with the photosensor 40.

Figure 5A:
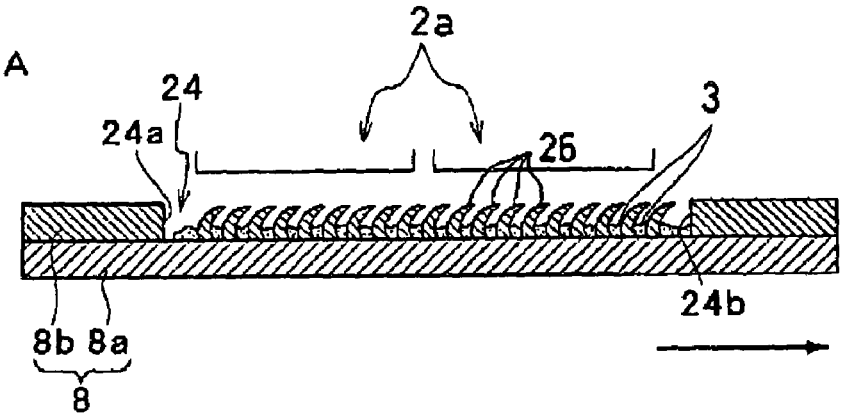
FIGS. 5A to 5C are enlarged sectional views chronologically illustrating a vicinity of a recessed portion in a widthwise center of the conveyor belt in accordance with running of the conveyor belt.
Figure 5B:
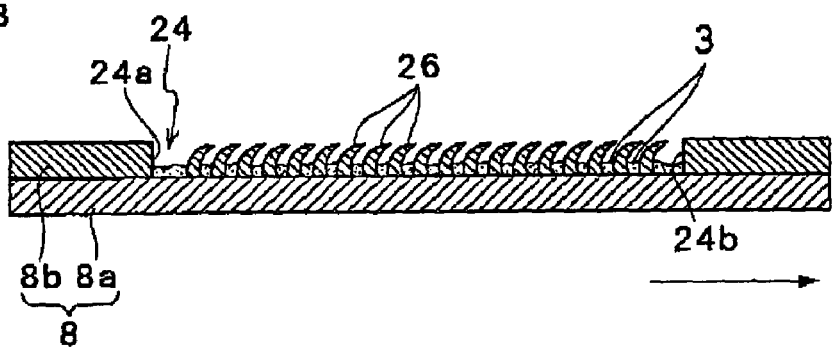
Figure 5C:
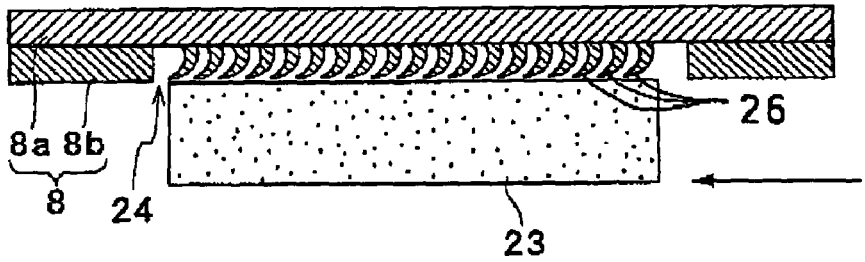

Next, a movement of ink flushed onto the conveyor belt 8 will be described with reference to FIGS. 5A to 5C. FIGS. 5A to 5C are enlarged sectional views chronologically illustrating a vicinity of a recessed portion in a widthwise center of the conveyor belt in accordance with running of the conveyor belt. FIGS. 5A and 5B illustrate points where the recessed portion 24 is traveling on the upper path of the conveyor belt 8, and FIG. 5C illustrates a point where the recessed portion 24 is traveling on the lower path of the conveyor belt 8.

For example, a timing of a flushing is controlled as follows. A time period from a time point when the photosensor 40 detects the recessed portion 24 as a flushing region until this recessed portion 24 reaches the position corresponding to two heads 2 is calculated and stored in advance. Accordingly, as a practical matter, after the photosensor 40 detects the recessed portion 24 and then the stored time period passed, ink is ejected from the heads 2 into the recessed portion 24.

To perform a flushing, first, with the conveyor belt 8 running, when the recessed portion 24 faces two head main bodies 2*a* near the roller 7, among the four head main bodies 2*a*, as illustrated in FIG. 5A, ink is ejected from all the nozzles of these two head main bodies 2*a* toward the recessed portion 24 of the conveyor belt 8. The ejected ink 3 is then held in the grooves between the protrusions 26 in the recessed portion 24.

Subsequently, the conveyor belt 8 keeps running. When the recessed portion 24 faces two head main bodies 2*a* near the roller 6, among the four head main bodies 2*a*, ink is ejected from all the nozzles of these two head main bodies 2*a* toward the recessed portion 24 of the conveyor belt 8. The ejected ink 3 is then held in the grooves between the protrusions 26 in the recessed portion 24. At this time, in accordance with running of the conveyor belt 8, the ink 3 ejected from the two head main bodies 2*a* near the roller 7 inclines to travel in reverse of the running direction by its inertia. However, due to the protrusions 26, the ink 3 cannot go out of the grooves between the protrusions 26.

When the conveyor belt 8 runs after the ink jection from the two head main bodies 2*a* near the roller 6, also, the ink 3 held in the grooves between the protrusions 26 cannot go out of the grooves. Thus, as illustrated in FIG. 5B, even when the recessed portion 24 reaches a rightmost portion of the upper path (a nearest portion to the roller 6), the ink 3 is still held in the grooves between the protrusions 26 without traveling. When the conveyor belt 8 further runs and the recessed portion 24 reaches the lower path of the conveyor belt 8, similarly to the above, the ink 3 is still held in the grooves between the protrusions 26 without traveling. Since the ink 3 is a small amount in itself, the ink 3 is held in the grooves against gravity even when the recessed portion 24 faces downward.

Then, when the recessed portion 24 comes to a position corresponding to the ink removing member 23 (a position shown in FIG. 1), the ink removing member 23 is brought into contact with the protrusions 26 as illustrated in FIG. 5C. The running of the conveyor belt 8 temporarily stops in this state. At this time, the ink 3 held in the grooves between the protrusions 26 is absorbed into the ink removing member 23 and removed. More specifically, the ink 3 is absorbed into the ink removing member 23 due to a capillary force generated by the ink removing member 23, and thus drained out of the grooves between the protrusions 26. That is, a material having an absorbing power stronger than an ink holding power in the grooves between the protrusions 26 is used as the ink removing member 23.

Next, a movement of the ink removing member 23 will be described with reference to FIGS. 6A and 6B. The ink removing member 23 is supported on one end of a supporting member 32 swingable around a shaft 32*a*. On the other end of the supporting member 32, a solenoid 30 is arranged at a terminal, and a spring 31 is disposed to be a little nearer the one end than the terminal is. The spring 31 always biases downward the other end of the supporting member 32

Figure 6A:
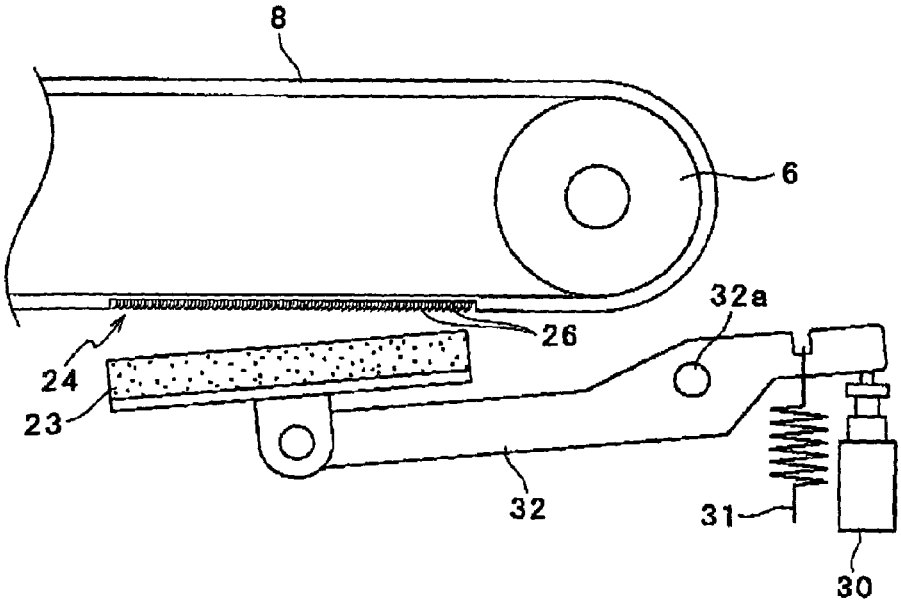
FIGS. 6A and 6B are partial side views illustrating a drive mechanism of an ink removing member illustrated in FIG. 1.

FIG. 6A illustrates that the recessed portion 24 is not in the position corresponding to the ink removing member 23. In this state, the solenoid 30 is open and the other end of the supporting member 32 is pushed upwardly against the biasing force of the spring 31. Thus, one end of the supporting member 32 is arranged downward, and the ink removing member 23 supported on the one end is fixed in a position to be out of abutment with the surface of the conveyor belt 8.

Figure 6B:
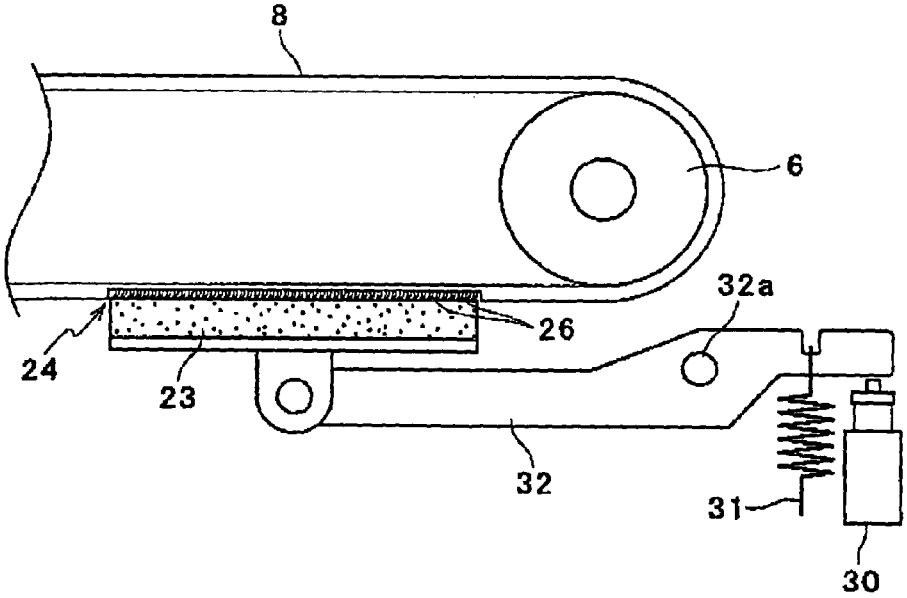

When the recessed portion 24 comes to a position corresponding to the ink removing member 23, the running of the conveyor belt 8 stops, and the solenoid 30 closes so that the other end of the supporting member 32 moves downwardly due to a biasing force of the spring 31, as illustrated in FIG. 6B. Thus, the supporting member 32 rotates clockwise around the shaft 32*a* in FIG. 6B. As a consequence, the one end of the supporting member 32 moves upwardly, so that the ink removing member 23 supported on the one end comes to a position for being in contact with the protrusions 26.

After a predetermined time elapses since the ink removing member 23 contacts with the protrusions 26, the solenoid 30 opens and the state illustrated in FIG. 6A is restored.

This movement of the ink removing member 23 can be obtained by opening and closing the solenoid 30 at a predetermined point on the basis of a position of the recessed portion 24 and a running speed of the conveyor belt 8 detected by the photosensor 40 (see FIG. 1).

This movement of the ink removing member 23 is achieved as follows, for example. A time period from a time point when the photosensor 40 detects the recessed portion 24 until this recessed portion 24 reaches the position corresponding to the ink removing member 23 is calculated and stored in advance, based on a distance along the conveyor belt 8 between the position of the photosensor 40 and the position corresponding to the ink removing member 23 and on the traveling speed of the conveyor belt 8. Then the time period is stored. Accordingly, as a practical matter, after the photosensor 40 detects the recessed portion 24 and then the stored time period passed, the ink removing member 23 is moved toward the conveyor belt 8 by the drive mechanism.

As described above, although the ink-jet printer 1 having the belt conveying mechanism 13 of this embodiment is line type, a speedy flushing can be performed with a relatively simple structure without a withdrawal of a conveyor belt 8 or an ink-jet head 2, by ejecting ink toward the recessed portion 24. Therefore, a manufacture cost can be reduced, a downsizing of the ink-jet printer 1 can be realized, and the number of printed sheets per time can be increased.

The conveyor belt 8 is not formed with any opening for flushing but with the recessed portion 24 only, thereby to provide a reduced deterioration in strength of the conveyor belt 8. Thus, a desired belt tension may be obtained, without any drawbacks in a paper conveyance path, and further, a life of the conveyor belt 8 is hardly shortened.

The ink 3 flushed to the recessed portion 24 and then held in the grooves between the protrusions 26 is removed by being rapidly absorbed into the ink removing member 23. Accordingly, printings after flushing see few drawbacks. Moreover, a slip of the belt does not occur so much because an inner peripheral surface of the belt and the roller 6 and 7 are not stained with the ink 3.

Further, in this embodiment, the many protrusions 26 are formed on the bottom face of the recessed portion 24, so as to prevent the flushed ink 3 from concentrating at a vicinity of the stepped portion 24*a* due to the inertia in accordance with the running of the conveyor belt 8. Therefore, the ink 3 is held in a plurality of parts in the recessed portion 24 partitioned by the protrusions 26. Thus, an overflow of the ink 3 from the recessed portion 24 is restrained.

In this embodiment, particularly, since the protrusions 26 protrude perpendicularly to the surface of the conveyor belt 8, the protrusions 26 may be formed with a large height to thereby increase an amount of ink to be held in the recessed portion 24. Besides, a heightening of the protrusions 26 may prevent the flushed ink 3 from going over the protrusions 26 during a running of the belt. In this point as well, the overflow of the ink 3 from the recessed portion 24 is restrained.

Further, each protrusion 26 extends in parallel with each other perpendicularly to the running direction, and each protrusion 26 has an overhanging form with a tip portion there of inclining forwardly in the running direction. This configuration makes it difficult for the flushed ink 3 to go over the protrusions 26 and move to a rear end in the belt running direction due to the inertia in accordance with the running of the conveyor belt 8. In this point as well, the overflow of the ink 3 from the recessed portion 24 is restrained.

Further, since each protrusion 26 extends in parallel with each other perpendicularly to the running direction, a relatively large surface tension generates between the protrusions 26. Accordingly, even when a large amount of ink is ejected to the recessed portion 24 by a flushing, the ink 3 is supported between the protrusions 26 because of the surface tension. Therefore, the ink 3 hardly drops down even in case that the recessed portion 24 faces sideward or downward, thereby suppressing a staining with ink within the printer 1.

Further, since the recessed portion 24 is formed with the sidewalls 24*c* and 24*d*, the ink is prevented from dropping outside from widthwise ends of the conveyor belt S. Thus, a staining with ink within the printer 1 is reduced.

Further, the ink removing member 23 can selectively take a position for being in contact with the protrusions 26 and a position for being out of contact with the protrusions 26. More specifically, on the basis of a position of the recessed portion 24 and a running speed of the conveyor belt 8 detected by the photosensor 40, the ink removing member 23 is driven by the solenoid 30 to get in contact with the protrusions 26 when the recessed portion 24 is in the position corresponding to the ink removing member 23, and to get apart from the protrusions 26 when the recessed portion 24 is in the position not corresponding to the ink removing member 23. Thus, a friction between the ink removing member 23 and the conveyor belt 8 can be minimized. Moreover, ink soaked in the ink removing member 23 can be prevented to the utmost from adhering to the conveyor belt 8, thereby, from this viewpoint as well, advantageously restraining a slip of the belt and an ink transfer to a paper.

The protrusions 26 may not protrude perpendicularly to the surface of the conveyor belt 8, and may protrude, for example, slantingly with respect to the surface of the conveyor belt 8. Moreover, the protrusions 26 may not extend in parallel with each other perpendicularly to the running direction, and may be pillar-like portions protruding disorderly within the recessed portion 24.

Figure 7:
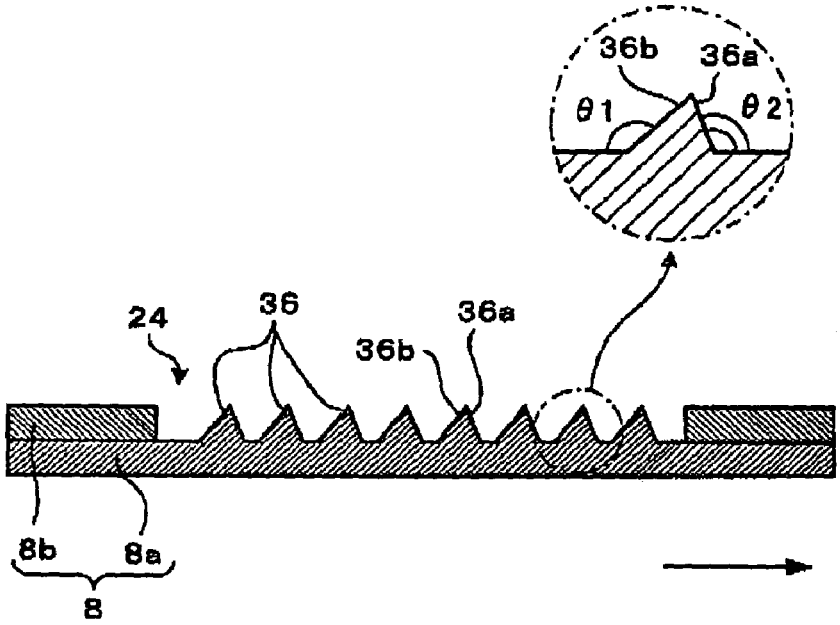
FIG. 7 is a partial sectional view of a modification of the conveyor belt illustrated in FIG. 1.

Further, each protrusion 26 may not have an overhanging form with the tip portion thereof inclining to the downstream of the running direction. For example, FIG. 7 shows a modification of the protrusions. The protrusion 36 of this modification has a slant face 36*a* on a downstream side of the running direction and a slant face 36*b* on an upstream side of the running direction. An angle □1 between the slant face 36*b* and the surface of the conveyor belt 8 is larger than an angle □2 between the slant face 36*a* and the surface of the conveyor belt 8. This configuration disables flushed ink from going over the protrusion, and, in addition, maybe formed relatively with ease.

Still further, the ink removing member 23 is not limited to be made of felt, and a size and location thereof may also be arbitrarily changed as long as the ink removing member 23 can sufficiently absorb the ink 3. The ink removing member 23 may, for instance, be in contact with the protrusions 26 or 36 on the upper path of the conveyor belt 8 or be in contact with the protrusions 26 or 36 when locating in a position corresponding to the roller 6 as in a second embodiment described below.

Still further, the distance L between the stepped portions 24*a* and 24*c* in the recessed portion 24 (see FIG. 2) may be changed, and may be slightly longer than the width of one head main body 2*a* as in a below-described second embodiment, or slightly longer than four times the width of the head main body 2*a*. In these cases, the number of head main bodies 2*a* forming a unit for performing one flushing is changed.

Next, an ink-jet printer comprising a belt conveying mechanism according to a second embodiment of the present invention will be described with reference to FIGS. 8 and 9. A belt conveying mechanism 113 of this embodiment is applied to an ink-jet printer 1 similar to that in the first embodiment. The components similar to those in the first embodiment will not be described while they will be indicated by the common reference numerals or will not be illustrated.

In the belt conveying mechanism 113 of this embodiment, an absorber 126 made of polymeric porous materials such as urethane is arranged in a recessed portion 124 formed on a surface of a conveyor belt 8. The absorber 126 functions as an ink holding portion instead of the protrusions 26 in the first embodiment. The absorber 126 is thinner than an outer sheet 8*b* so as not to protrude from the surface of the conveyor belt 8. It is preferable that the absorber 126 is capable of a large amount of ink, e.g., an amount of ink several-ten times the amount of ink ejected on one flushing.

A cylindrical ink removing roller (ink removing member) 123 made of, e.g., rigid metallic material is arranged below a roller 6. The ink removing roller 123 is a member for removing ink held in the absorber 126, that is, a substitutional member for the ink removing member 23 in the first embodiment. The ink removing roller 123 is supported on one end of a supporting member 132 rotatably around a shaft 123*a* parallel to a widthwise direction of the conveyor belt 8 (perpendicular direction to FIG. 8). The supporting member 132 is swingable around a shaft 132*a*. On the other end of the supporting member 132, similarly to the supporting member 32 (see FIGS. 6A and 6B) in the first embodiment, a solenoid 130 is disposed at a terminal, and a spring 131 is disposed to be a little nearer the one end than the terminal is. The spring 131 always biases downward the other end of the supporting member 132.

Similarly to the first embodiment, due to a drive mechanism such as the solenoid 130, etc., the ink removing roller 123 can selectively take a position for being in contact with the absorber 126 as an ink holding portion and a position for being out of contact with the absorber 126. A movement of the ink removing roller 123 will be described later in detail.

Figure 8:
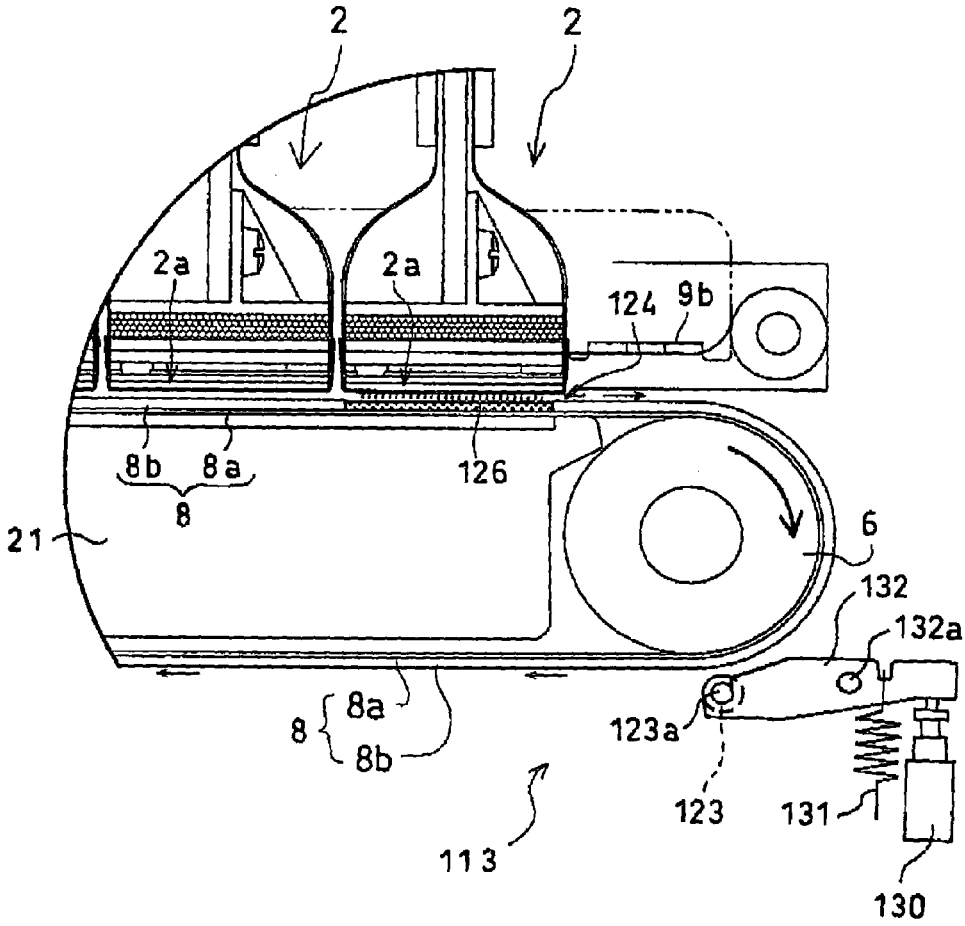
FIG. 8 is a partial front view of an ink-jet printer comprising a belt conveying mechanism according to a second embodiment of the present invention.

FIG. 8 illustrates a state where a flushing is being performed. In this embodiment, a length of the recessed portion 124 in a longitudinal direction of the conveyor belt 8 is approximately the same as a width of one head main body 2*a*. One ink-jet head 2 is set to form one unit for performing a flushing toward the recessed portion 124.

Similarly to the first embodiment, flushed ink 3 is held by the absorber 126, and the ink 3 does not overflow from the recessed portion 124 as long as an amount of ink 3 is less than an ink capacity of the absorber 126. Accordingly, as in the first embodiment, the ink 3 is held in the absorber 126 against gravity even when the recessed portion 124 faces downward. That is, the conveyor belt 8 can be circled with the absorber 126 holding the ink 3, as long as the amount of ink 3 held in the absorber 126 is less than the ink capacity of the absorber 126.

Figure 9:
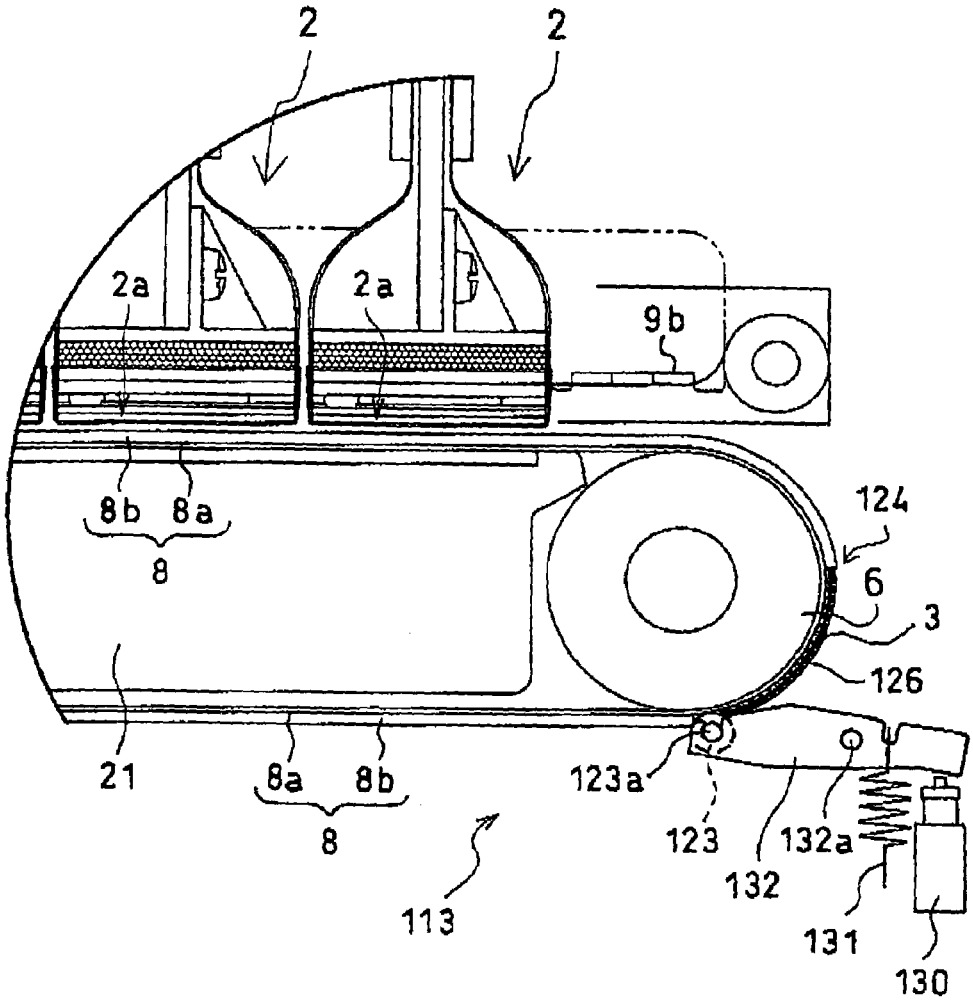
FIG. 9 is a partial front view illustrating a state where an ink removing roller illustrated in FIG. 8 is in contact with an absorber arranged in a recessed portion in a conveying belt.

FIG. 9 illustrates a state where the recessed portion 124 comes below the roller 6 with the ink 3 being held in the absorber 126, and the ink removing roller 123 is in contact with the absorber 126. When the conveyor belt 8 runs in the state shown in FIG. 9, the ink removing roller 123, kept in the state of contacting with the absorber 126 (in more detail, pressing the absorber 126), rotates around the shaft 123*a* and moves with respect to the conveyor belt 8 in reverse of the running direction. In accordance with this movement, the ink 3 held in the absorber 126 is removed in a squeezing manner, and then the absorber 126 restores nearly the initial ink capacity. The removed ink is contained in, for example, a non-illustrated ink container, etc.

An movement of the ink removing roller 123 will here be described. When the recessed portion 124 is not in a position corresponding to the ink removing roller 123 as illustrated in FIG. 8, the solenoid 130 is open and the other end of the supporting member 132 is pushed upwardly against a biasing force of the spring 131. Thus, one end of the supporting member 132 is disposed downward, and the ink removing roller 123 supported on the one end is fixed in a position to be out of abutment with the surface of the conveyor belt 8.

In order to contact the ink removing roller 123 with the absorber 126 at a timing when the recessed portion 124 reaches a position corresponding to the ink removing roller 123, the solenoid 30 is closed slightly earlier than that timing. When the solenoid 30 closes, the other end of the supporting member 132 moves downward due to the biasing force of the spring 131, and the supporting member 132 rotates clockwise in FIG. 8 around the shaft 132*a*. The one end of the supporting member 132 thereby moves upwardly, and the ink removing roller 123 supported on the one end takes the position for being in contact with the absorber 126, as illustrated in FIG. 9.

Subsequently, the conveyor belt 8 further runs, and the solenoid 130 opens before the ink removing roller 123 abuts against an end portion of the recessed portion 124 on the upstream side of the running direction, and then the state shown in FIG. 8 is restored.

During an ink removing operation by the ink removing roller 123, a running speed of the conveyor belt 8 is preferably lower than the speed in printing.

A position of the recessed portion 124 is detectable by the photosensor 40 (see FIG. 1), similarly to the first embodiment. The above-described movement of the ink removing roller 123 can be obtained by opening and closing the solenoid 130 at a predetermined point on the basis of a position of the recessed portion 124 and a running speed of the conveyor belt 8 detected by the photosensor 40.

For example, time periods from each time point when the photosensor 40 detects end portions of the recessed portion 124 on upstream and downstream sides of the running direction until the each end portion of the recessed portion 124 reaches the position corresponding to the ink removing roller 123 are calculated in advance, based on a distance along the conveyor belt 8 between the position of the photosensor 40 and the position corresponding to the ink removing member 123 and on the traveling speed of the conveyor belt 8. Then the time period is stored. Accordingly, as a practical matter, after the photosensor 40 detects the each end portion of the recessed portion 124 and then the respective stored time periods passed, the ink absorber 27 is moved toward and apart from the conveyor belt 8 by the drive mechanism. Therefore, the ink removing member 123 does not contact with the end portions of the recessed portion 124 on upstream and downstream sides of the running direction, As described above, according to the belt conveying mechanism 113 of the present embodiment, the same effects as in the first embodiment can be obtained such as effects that a speedy flushing can be performed with a relatively simple structure, that a deterioration in strength of the conveyor belt 8 is considerably reduced, and that printings after flushing see few drawbacks caused by the ink 3 flushed to the recessed portion 124.

Moreover, as in the first embodiment, since the ink removing roller 123 can selectively take a position for being in contact with the absorber 126 and a position for being out of contact with the absorber 126, a friction between the ink removing roller 123 and the conveyor belt 8 can be minimized. Further, ink adhered to the ink removing roller 123 can be prevented to the utmost from adhering to the conveyor belt 8, thereby, from this viewpoint as well, advantageously restraining a slip of the belt and an ink transfer to a paper.

In addition to the above effects, in this embodiment, an ink removing operation is performed more effectively because, when the absorber 126 is in the position corresponding to the roller 6, the ink removing roller 123 comes in contact with the absorber 126 so as to remove ink. That is, a presence of the roller 6 made of a rigid material enables the ink removing roller 123 to be pressed against the absorber 126. Therefore, the ink 3 can efficiently be squeezed out to be removed from the absorber 126.

Further, as the ink removing roller 123 of this embodiment is a cylindrical, the conveyor belt 8 can smoothly run even during an ink removing operation.

A material of the ink removing roller 123 is not limited to rigid metallic materials, and may be made of various materials such as flexible materials. In the structure of this embodiment, however, the ink removing roller 123 is preferably made of materials that do not absorb ink.

Additionally, in this embodiment, although the ink removing operation is performed at the position corresponding to the roller 6, the ink removing operation may be performed at a position corresponding to the other roller 7. Further, the ink removing operation may be performed at a position not corresponding to the rollers 6 and 7, as in the first embodiment.

The protrusions 26 and the absorber 126 in the first and second embodiments, respectively, serve as the ink holding portion of the present invention. However, other various members and constructions capable of holding ink may be used.

In the first and second embodiments, moreover, an ink holding portion may be directly arranged on the surface of the conveyor belt 8 instead of forming the recessed portion 24, 124 on the surface of the conveyor belt 8. In this case, ink is ejected toward the ink holding portion arranged on the surface of the conveyor belt 8 during a flushing. However, in order to relieve the problem that ink leaks out of an ink holding portion and adheres to the surface of the conveyor belt 8 other than a region where the ink holding portion is arranged and to the other members within the printer, it is preferable to form the recessed portion 24, 124 and dispose an ink holding portion within the recessed portion 24, 124.

The ink removing member 23 and the ink removing roller 123 in the first and second embodiment, respectively, serve as the ink removing member of the present invention. However, any other member may be used as long as the member can remove ink held in the ink holding portion. For example, a blade for scraping ink out, or a suction port arranged at any position (on either upper and lower sides) on the perimeter of the conveyor belt 8, etc., may be used in the first embodiment. A member having a larger absorbing power than that of the absorber 126, or a member for capping the absorber 126 to absorb and remove ink held in the absorber 126, etc., may be used in the second embodiment.

In the first and second embodiments, further, the ink removing member 23 and the ink removing roller 123 can selectively take positions for being in contact with and out of contact with the protrusions 26 and the absorber 126, respectively, serving as an ink holding portion. However, for example, they may be arranged fixedly so as to be always in contact with the surface of the conveyor belt 8.

Further, the ink removing operation of the ink removing member may be performed when the conveyor belt is temporarily stopping or when the conveyor belt is running. In the first embodiment, for instance, even when the conveyor belt 8 is kept running without a temporary stop, the ink 3 held in the grooves between the protrusions 26 can be removed by appropriately adjusting a running speed of the conveyor belt 8 and a position and size of the ink removing member 23.

Still further, the belt conveying mechanisms 13 and 113 may further comprise a mechanism for draining outside the ink absorbed into the ink removing member 23 or a mechanism for cleaning the ink removing roller 123, respectively.

Still further, a material other than polyester may be used as the material of the inner sheet.

Still further, the conveyor belt 8 need not always have a two-layered structure, and may have a layered structure with three or more layers or with a single layer.

The present invention is applicable not only to a line-type but to a serial-type ink-jet printer.

Further, an application of the present invention is not limited to an ink-jet printer. The present invention is also applicable to, for example, an ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A belt conveying mechanism for an ink-jet recording apparatus comprising:

a plurality of rollers;

a conveyor belt that conveys a recording medium on a conveying surface thereof, the conveyor belt spanning the plurality of rollers and including a recessed portion that includes a top edge defined by the conveying surface;

an ink holding portion that holds ink and comprises a plurality of protrusions projecting from a surface of the recessed portion of the conveyor belt; and an ink removing member that removes the ink held in the ink holding portion, wherein a top-most portion of each protrusion is below the top edge of the recessed portion.

2. The belt conveying mechanism for an ink-jet recording apparatus according to claim 1, the ink holding portion is arranged within the recessed portion to hold ink within the recessed portion.

3. The belt conveying mechanism for an ink-jet recording apparatus according to claim 1, wherein the conveyor belt includes a recessed portion and the ink holding portion includes a plurality of protrusions formed on a surface of the recessed portion of the coneyor belt.

4. The belt conveying mechanism for an ink-jet recording apparatus according to claim 3, wherein the plurality of protrusions are positioned below a conveying surface of the conveyor belt on which the recording medium is conveyed.

5. The belt conveying mechanism for an ink-jet recording apparatus according to claim 1, wherein the plurality of protrusions include at least a first portion that protrudes substantially perpendicularly or exactly perpendicularly relative to the conveying surface of the conveyor belt.

6. The belt conveying mechanism for an ink-jet recording apparatus according to claim 5, further comprising a second portion that extends from the first portion and projects toward a downstream of a running direction of the conveyor belt.

7. The belt conveying mechanism for an ink-jet recording apparatus according to claim 1, wherein the plurality of protrusions extend substantially parallel or exactly parallel to each other and the plurality of protrusions extend substantially perpendicular or exactly perpendicular to a running direction of the conveyor belt.

8. The belt conveying mechanism for an ink-jet recording apparatus according to claim 1, wherein each of the plurality of protrusions has an overhanging portion thereof that inclines toward a downstream of a running direction of the conveyor belt.

9. The belt conveying mechanism for an ink-jet recording apparatus according to claim 1, wherein an angle between the surface of the recessed portion of the conveyor belt and a face of each protrusion on an upstream side of a running direction of the conveyor belt is larger than an angle between the surface of the recessed portion of the conveyor belt and a face of the protrusion on a downstream side of the running direction of the conveyor belt.

10. The belt conveying mechanism for an ink-jet recording apparatus according to claim 1, wherein the ink removing member is made of felt.

11. The belt conveying mechanism for an ink-jet recording apparatus according to claim 1, wherein the ink removing member has a same length as the recessed portion in a running direction of the conveyor belt.

12. The belt conveying mechanism for an ink-jet recording apparatus according to claim 1, wherein, when at least a portion of the ink holding portion is overlapping any of the plurality of rollers, the ink removing member is brought into contact with the ink holding portion to remove ink.

13. The belt conveying mechanism for an ink-jet recording apparatus acording to claim 1, wherein the ink removing member is a cylindrical roller.

14. The belt conveying mechanism for an ink-jet recording apparatus according to claim 1, wherein the ink removing member can selectively take a position for being in contact with the ink holding portion and a position for being out of contact with the ink holding portion.

15. An ink-jet recording apparatus, comprising:

the belt conveying mechanism according to claim 1; and an ink-jet head that ejects ink onto the record medium being conveyed by the conveyor belt.

16. The belt conveying mechanism for an ink-jet recording apparatus according to claim 1, wherein the conveyor belt includes an inner layer and an outer layer, wherein the conveying surface of the conveyor belt corresponds to a surface of the outer layer.

17. A belt conveying mechanism for an ink-jet recording apparatus comprising:

a plurality of rollers;

a conveyor belt that conveys a recording medium thereon, the conveyor belt spanning the plurality of rollers;

an ink holding portion that holds ink, the ink holding portion including an absorber arranged on a surface of the conveyor belt; and an ink removing member that removes the ink held in the ink holding portion and includes a cylindrical roller.

wherein the ink removing member is selectively arrangeable in one of a contacting state where the ink removing member contacts the ink holding member or an uncontacting state where the ink removing member does not contact the ink holding member. and the ink removing member being arranged in the contacting state when the ink holding portion is in a position corresponding to any of the plurality of rollers.

18. The belt conveying mechanism for an ink-jet recording apparatus according to claim 17, wherein the ink removing member is made of metallic material.

19. The belt conveying mechanism for an ink-jet recording apparatus according to claim 17, wherein the ink holding portion is in a position corresponding to any of the plurality of rollers when at least a portion of the ink holding portion is overlapping any of the plurality of rollers and is between any of the plurality of rollers and the ink removing member.

20. A belt conveying mechanism for an ink-jet recording apparatus, comprising:

a plurality of rollers;

a conveyor belt that conveys a recording medium on a conveying surface thereof, the conveyor belt spanning the plurality of rollers and including a recessed portion that includes a top edge defined by the conveying surface;

an ink holding portion that holds ink and comprises a plurality of protrusions projecting from a surface of the recessed portion of the conveyor belt;

an ink removing member that removes the ink held in the ink holding portion;

a sensor that detects a position of the ink holding portion; and a drive mechanism that selectively moves the ink removing member into contact or out of contact with the ink holding portion, based on the position of the ink holding portion and a running speed of the conveyor belt detected by the sensor, wherein a top-most portion of each protrusion is below the top edge of the recessed portion.

* * * * *